US008525736B2

(12) United States Patent
Yukimoto et al.

(10) Patent No.: US 8,525,736 B2
(45) Date of Patent: Sep. 3, 2013

(54) ANTENNA DEVICE

(75) Inventors: Shinsuke Yukimoto, Tokyo (JP); Takao Yokoshima, Tokyo (JP)

(73) Assignees: Mitsubishi Cable Industries, Ltd., Tokyo (JP); Mitsubishi Materials Corporation, Tokyo (JP)

( * ) Notice: Subject to any disclaimer, the term of this patent is extended or adjusted under 35 U.S.C. 154(b) by 833 days.

(21) Appl. No.: 12/667,614

(22) PCT Filed: Jul. 3, 2008

(86) PCT No.: PCT/JP2008/001755

§ 371 (c)(1),
(2), (4) Date: Jan. 4, 2010

(87) PCT Pub. No.: WO2009/004811

PCT Pub. Date: Jan. 8, 2009

(65) Prior Publication Data

US 2010/0194658 A1 Aug. 5, 2010

(30) Foreign Application Priority Data

Jul. 5, 2007 (JP) ..... 2007-176941
Jul. 5, 2007 (JP) ..... 2007-176942

(51) Int. Cl.
*H01Q 1/24* (2006.01)
*H01Q 1/50* (2006.01)

(52) U.S. Cl.
USPC ..... 343/702; 343/860

(58) Field of Classification Search
USPC ..... 343/702, 850, 860, 846, 745, 749, 343/866
See application file for complete search history.

(56) References Cited

U.S. PATENT DOCUMENTS 6,147,652 A * 11/2000 Sekine ..... 343/702
7,242,364 B2 * 7/2007 Ranta ..... 343/860

FOREIGN PATENT DOCUMENTS

CN 1663075 A 8/2005
JP 11-154815 A 6/1999
JP 2005-39594 A 2/2005
WO 2004/001902 A1 12/2003

OTHER PUBLICATIONS

International Search Report for Appln. No. PCT/JP2008/001755 dated Sep. 2, 2008.
Notice of 2nd Refusal dated Sep. 25, 2012 issued in corresponding Chinese patent application No. 200780011966.3.

* cited by examiner

*Primary Examiner* — Robert Karacsony
*Assistant Examiner* — Hasan Islam
(74) *Attorney, Agent, or Firm* — Carter, DeLuca, Farrell & Schmidt, LLP

(57) ABSTRACT

An antenna element has an upstanding section erected from a base member; a tuning section extended from the upper end of the upstanding section into one direction in a parallel plane parallel to the base member, bent in the middle, and then extended in the direction opposite the one direction; and an open element section extended from the front end of the tuning section in the direction in which the open element section spirally turns in the parallel plane about the upstanding section.

10 Claims, 22 Drawing Sheets

ANTENNA DEVICE

TECHNICAL FIELD

The present disclosure relates to an antenna device for wireless communication technology such as a vehicle keyless operation system.

BACKGROUND OF THE DISCLOSURE

In recent years, for the purpose of wireless communication such as a keyless operation system for a vehicle, an antenna device having a linear element has been utilized. As an antenna device utilizing a linear element, a monopole antenna on which a wire element with a ¼ length of an antenna operation wavelength disposed to a ground plate has been conventionally and generally used. However, since the overall size and height of the monopole antenna are large and high, an inverse L-type antenna in which the monopole antenna is bent in the middle so as to reduce the size and height thereof is being developed.

Furthermore, in the inverse L-type antenna, a reactance section, which is determined by the length of the horizontal portion of an antenna element parallel to the ground plate, is capacitive and becomes a large value, thereby making it difficult to match with respect to a 50Ω power feed line. Hence, in order to facilitate the matching between the antenna element and the 50Ω power feed line, a so-called inverse F-type antenna has conventionally been devised. The inverse F-type antenna is configured such that a stub which connects the ground plate to a radiation element is provided near a power feed point provided in the midway of the antenna element.

With this arrangement, it is easy to cancel out the capacitive reactance created by the reactance section so as to achieve matching with the 50Ω power feed line. For example, Japanese Unexamined Patent Application Publication No. 2006-197528,the entire contents of which is hereby incorporated by reference, discloses an inverse F-type antenna which is applicable to a folded-down portable wireless apparatus and which has an antenna element that is bent so as to be perpendicular to a flexible flat cable that is disposed on a printing wiring substrate and connected to a printing wiring substrate. In the inverse F-type antenna, the antenna element is also folded back in the vertical direction with respect to the printing wiring substrate.

However, even in the conventional technique described above, problems still remain. Specifically, in the conventional inverse F-type antenna, although a stub is provided near the power feed point in the midway of the antenna element, the occupation area of the matching section is enlarged, resulting in difficulty in attaining the reduction in size of the antenna. In addition, since the characteristics of the matching section with respect to the antenna element may be deteriorated, directivity is thereby limited, resulting in a disadvantage in which only one of polarization in horizontal plane and polarization in vertical plane is improved. Furthermore, although the inverse F-type antenna disclosed in Japanese Unexamined Patent Application Publication No. 2006-197528 described above improves the antenna characteristics by bending the length and width of the antenna element with respect to the flexible cable, such improvement depends on a surrounding environment. Thus, not only polarization and directivity cannot be improved, but also miniaturization and thinning are difficult due to its structure.

Accordingly, it would be advantageous to provide an antenna device that improves polarization and directivity and enhances further miniaturization and thinning.

SUMMARY

An antenna device is provided including a base member having a power feed point to which a power feed line is connected; an antenna element connected to the power feed point and erected on the base member; and a matching circuit section, which is connected to the power feed point and the antenna element, provided on the base member, and matches the reactance of the antenna element and that of the power feed line with each other, wherein the antenna element includes: an upstanding section erected from the base member; a tuning section, which corrects directivity or polarization, extended from the upper end of the upstanding section into one direction in a parallel plane parallel to the base member, bent or curved in the middle, and then extended in the direction opposite the one direction; and an open element section extended from the front end of the tuning section in the direction in which the open element section spirally turns in the parallel plane about the upstanding section.

DETAILED DESCRIPTION

Figure 1:
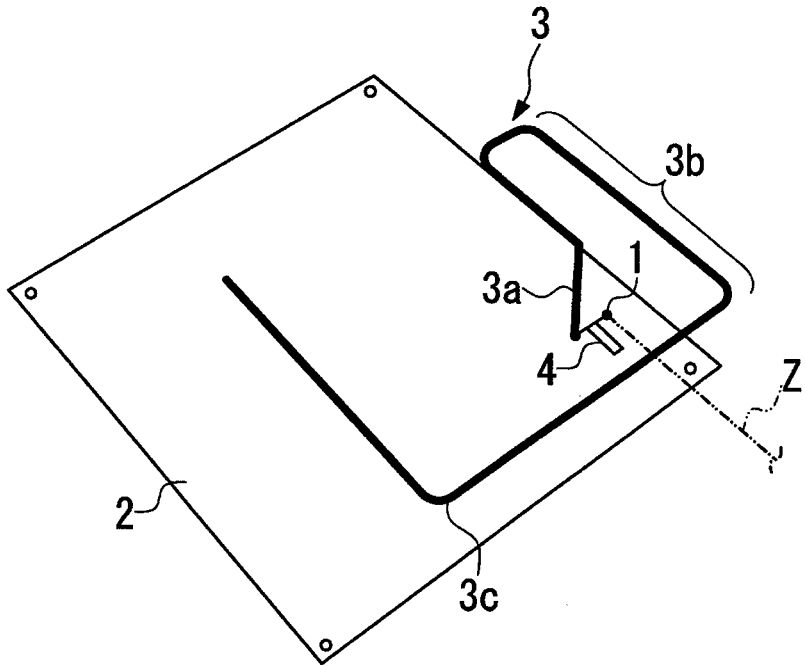
FIG. 1 is a simplified perspective view showing an antenna device according to a first embodiment of the present disclosure.

The antenna device of the present disclosure includes a base member having a power feed point to which a power feed line is connected; an antenna element connected to the power feed point and erected on the base member; and a matching circuit section, which is connected to the power feed point and the antenna element, provided on the base member, and matches the reactance of the antenna element and that of the power feed line with each other, wherein the antenna element includes an upstanding section erected from the base member; a tuning section, which corrects directivity or polarization, extended from the upper end of the upstanding section into one direction in a parallel plane parallel to the base member, bent or curved in the middle, and then extended in the direction opposite the one direction; and an open element section extended from the front end of the tuning section in the direction in which the open element section spirally turns in the parallel plane about the upstanding section.

In the antenna device, the matching circuit section, which matches the reactance of the antenna element and that of the power feed line with each other, is provided on the base member, whereby the need for providing a matching stub is eliminated unlike the conventional inverse F-type antenna, and the occupation area for the stub-matching portion can be reduced. It should be noted that the space saving of the overall antenna device may be achieved when a substrate on which a circuit and wiring lines are formed is used as the base member. In addition, according to the antenna device of the present disclosure, the antenna element may include a tuning section that is extended from the upper end of the upstanding section erected from the base member into one direction in a parallel plane parallel to the base member 2, bent in the middle, and then extended in the direction opposite the one direction, whereby the antenna element may provide tuning to the desired polarization and directivity by setting the length and shape of the tuning section. Furthermore, the antenna device may include an open element section that is extended from the front end of the tuning section in the direction in which the open element section spirally turns in the parallel plane about the upstanding section, whereby favorable antenna radiation may be obtained from the open element section.

The open element section of the antenna device of the present disclosure may be bent or curved in the middle and the front end thereof may be extended along the one direction. In other words, in the antenna device, the open element section is bent or curved in the middle and the front end thereof is extended along the one direction, whereby the overall configuration may be formed into a spiral shape, resulting in the reduction in size of the antenna device.

Furthermore, according to the antenna device of the present disclosure, the overall external shape combined of the tuning section and the open element section may be a substantially square shape. In other words, in the antenna device, the overall external shape combined of the tuning section and the open element section is of substantially square shape, whereby the directivity is less-polarized, resulting in more omnidirectionally-uniform directivity.

The antenna device of the present disclosure may include a base member having a power feed point to which a power feed line is connected; an antenna element connected to the power feed point and erected on the base member; and a matching circuit section, which is connected to the power feed point and the antenna element, provided on the base member, and matches the reactance of the antenna element and that of the power feed line with each other, wherein the antenna element includes an upstanding section erected from the base member; a tuning section, which corrects directivity or polarization, extended from the upper end of the upstanding section into one direction in a parallel plane parallel to the base member, bent or curved in the middle, and then extended in the direction opposite the one direction; an open element section extended from the front end of the tuning section in the direction in which the open element section spirally turns in the parallel plane about the upstanding section; and at least one projecting element section, which corrects directivity or polarization, projects from at least one of the tuning section and the open element section.

The antenna element may include at least one projecting element section that projects from at least one of the tuning section and the open element section, whereby the antenna element permits more tuning of the tuning section to the desired polarization and directivity by setting the position, number, length, and orientation of the projecting element section. In addition, the open end may be increased by the projecting element section, resulting in an increase in radiation intensity.

In addition, the projecting element section of the antenna device of the present disclosure may project toward the base member. In other words, according to the antenna device, the projecting element section projects toward the base member, whereby the projecting element sections may be disposed between the tuning section and the base member and between the open element section and the base member, and the reduction in size of the overall device is not precluded.

Furthermore, the front end of the projecting element section may be brought into abutment against the base member. In other words, according to the antenna device, the front end of the projecting element section is brought into abutment against the base member, whereby the projecting element section functions as a support that support the antenna element.

In addition, the projecting element section may be provided at the front end of the open element section. In other words, according to the antenna device, the projecting element section is provided at the front end of the open element section, whereby an effective length of the overall antenna element is extended, resulting in more improvement in the directivity of horizontal polarization.

The antenna device of the present disclosure includes a matching circuit section provided on the base member; and an antenna element having an upstanding section, a tuning section that corrects directivity or polarization, and an open element section, whereby the antenna device can be reduced in size without requiring a stub, and the tuning of polarization and directivity can be made so as to obtain favorable polarization and directivity. Since omnidirectional directivity may be obtained and further miniaturization and thinning may be achieved, the antenna device of the present disclosure may thereby be used for any one of a receiving antenna device, a transmitting antenna device, and a transmitting-receiving antenna device that are used for vehicle-mounted wireless communication system, in particular, keyless operation system.

Figure 2:
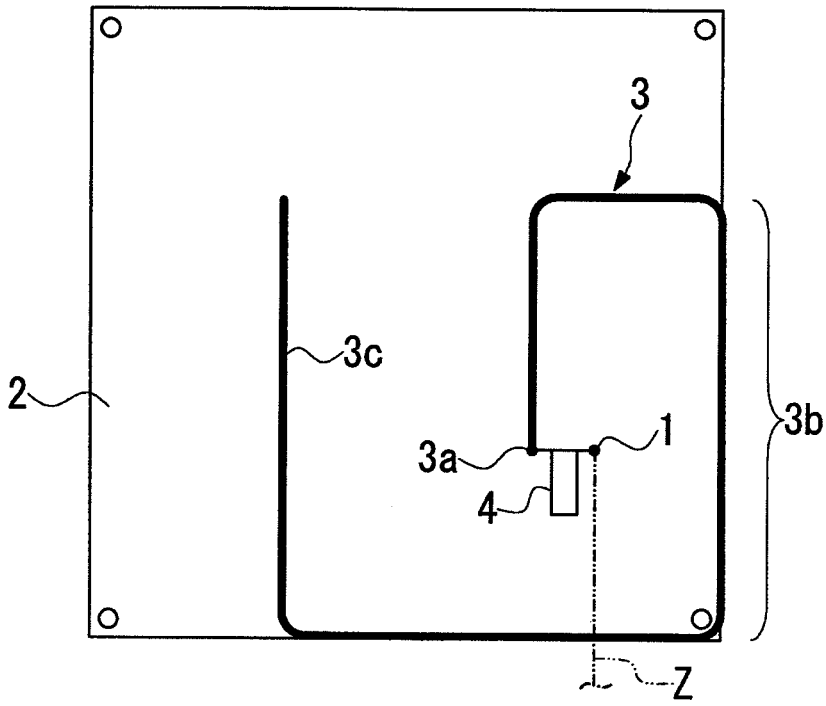
FIG. 2 is a simplified plan view showing the antenna device according to the first embodiment.

Hereinafter, the antenna device according to the first embodiment of the present disclosure will be described with reference to FIGS. 1 to 10. The antenna device according to the first embodiment is, for example, a receiving antenna device, a transmitting antenna device, and a transmitting-receiving antenna device that are used for vehicle-mounted wireless communication system, in particular, keyless operation system. As shown in FIGS. 1 and 2, the antenna device includes a base member 2 having a power feed point 1 to which a 50Ω power feed line Z is connected; an antenna element 3 connected to the power feed point 1 and erected on the base member 2; and a matching circuit section 4, which is connected to the power feed point 1 and the antenna element 3, provided on the base member 2, and matches the reactance of the antenna element 3 and that of the power feed line Z with each other.

It should be noted that the keyless operation system is a system that can perform a lock/unlock operation (so-called "keyless entry system") of a door, tailgate, and the like of a vehicle, an engine start-up operation, and the like, by performing ID code verification through wireless communication between a key and a receiving antenna device provided on the vehicle body side when the driver or the like who carries a key referred to as "keyless operation key" having a wireless communication function approaches the vehicle within the wireless operation range.

The base member 2 is, for example, a wiring substrate or a circuit board. A wireless communication circuit and an electronic control unit (ECU), which are not shown, are formed on the upper surface and the lower surface of the base member 2, respectively. It should be noted that the antenna element 3 may be attached on the opposite side of the surface onto which the electronic control unit of the base member 2 is mounted. The antenna element 3 may be formed of a conductive material such as a copper wire, a coated copper wire, a copper alloy wire (e.g., brass), an aluminum wire, a coated aluminum wire, an aluminum alloy wire, or the like, with a ¼ length of the antenna operation wavelength or an integral fraction of its length, and the thickness of the wire may be set depending on desired characteristics. In addition, examples of the shape of such wire material may include a circular cross section, a rectangular cross section, a polygon cross section, and the like. The circular cross section is preferred in consideration of the wire to be bent. In addition, the antenna element may be configured such that an insulating layer is coated on the outer periphery of the above-described conductive material (wire material).

The antenna element 3 has the upstanding section 3*a* erected from the base member 2; the tuning section 3*b*, which corrects directivity or polarization, extended from the upper end of the upstanding section 3*a* into one direction in a parallel plane parallel to the base member 2, bent or curved in the middle, and then extended in the direction opposite the one direction; and the open element section 3*c* extended from the front end of the tuning section 3*b* in the direction in which the open element section 3*c* spirally turns in the parallel plane about the upstanding section 3*a*.

In other words, the tuning section 3*b* is arranged to be extended from the upper end of the upstanding section 3*a* into the upward direction shown in FIG. 2, is bent in the middle at 90° in the right direction shown in FIG. 2, and is further bent at 90° in the downward direction shown in FIG. 2. Thus, the tuning section 3*b* is a portion that is bent into the C-shaped configuration with a constant width in the parallel plane. The width, length, or the like of the portion is set depending on the desired polarization and directivity. It should be noted that the shape of the bent corner edges may be chamfered to some degree in a circular-arc shape as shown in FIG. 2 or may be bent perpendicularly.

In addition, the open element section 3*c* is bent at 90° from the front end of the tuning section 3*b* in the left direction shown in FIG. 2, is extended across the power feed point 1, and is bent in the middle at 90° in the upward direction shown in FIG. 2. Thus, the open element section 3*c* is a portion that is bent into the L-shaped configuration in the parallel plane.

In addition, the open element section 3*c* is bent or curved in the middle, and the front end thereof is extended along the one direction. Furthermore, the overall external shape combined of the tuning section 3*b* and the open element section 3*c* is of substantially square shape. In this way, the tuning section 3*b* and the open element section 3*c* are formed in a rectangular spiral shape about the power feed point 1.

Figure 3:
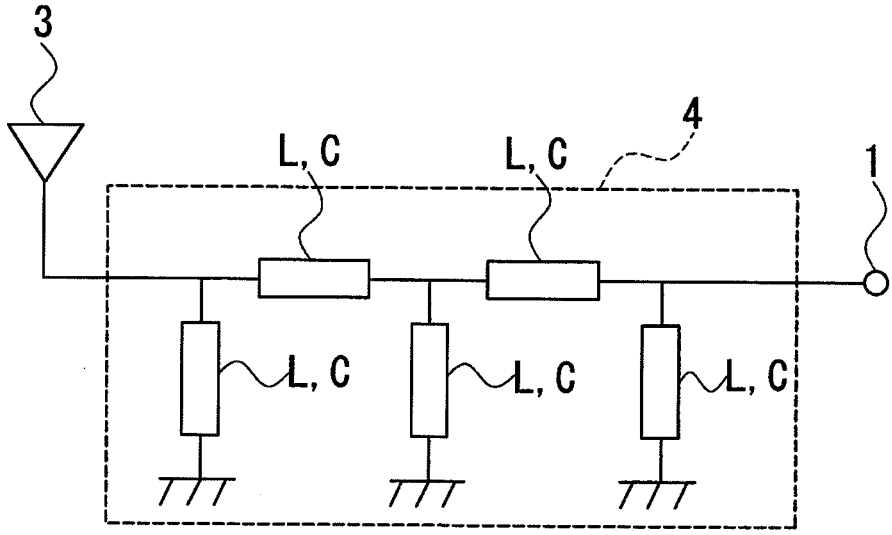
FIG. 3 is an equivalent circuit view showing a matching circuit section having a plurality of π-type LC circuits according to the first embodiment.
Figure 4:
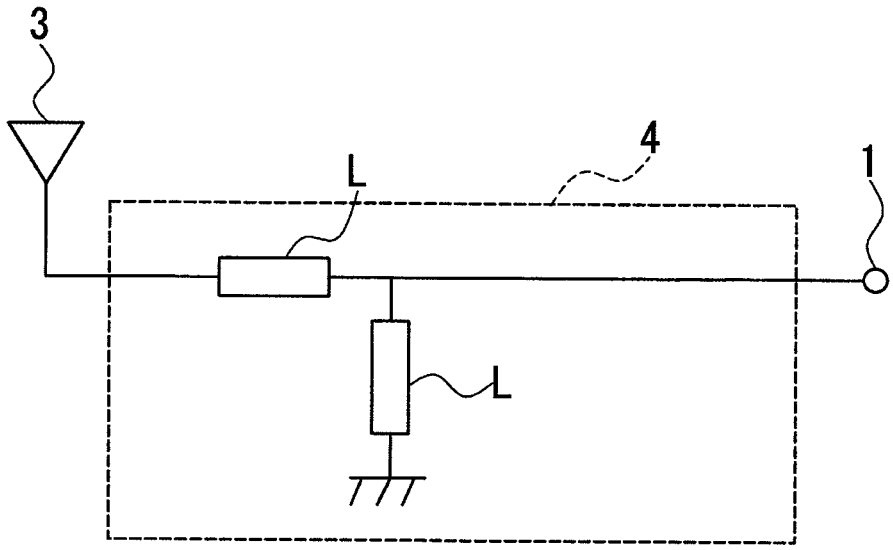
FIG. 4 is an equivalent circuit view showing the matching circuit section used in measuring the directional pattern according to the first embodiment.

As shown in FIGS. 3 and 4, the matching circuit section 4 is a circuit configuration in which a π-type LC circuit including a plurality of inductances L or capacitors C is provided in a single-stage or multiple-stages between the power feed point 1 and the antenna element 3. The matching circuit section 4 has a function corresponding to a portion that effects the matching from the power feed point to the stub in the conventional inverse F-type antenna.

Next, with respect to the antenna device of the first embodiment, a description will be given on the results obtained from the measurement of the directional pattern in the parallel plane for the actual polarization and directivity. It should be noted that in this measurement, a copper wire was used as the antenna element 3, and a circuit in which two inductances L are connected as shown in FIG. 4 was used as the matching circuit section 4.

Figure 5:
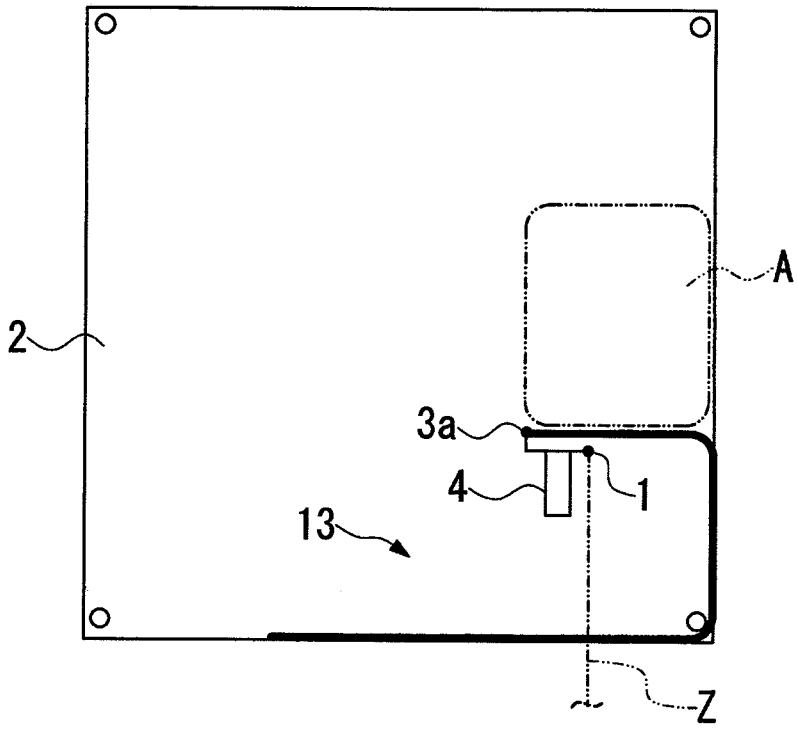
FIG. 5 is a simplified plan view showing the antenna device according to the comparative example (1) of the first embodiment.
Figure 6:
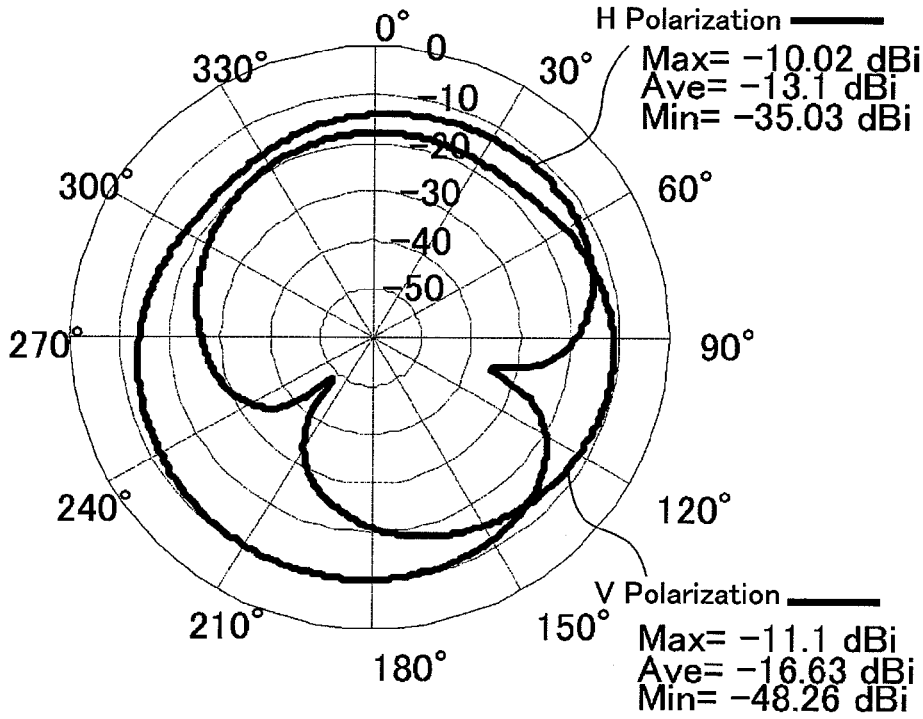
FIG. 6 is a graph showing the directional pattern in the parallel plane of the antenna device according to the comparative example (1) of the first embodiment.

First, for comparison, the directional pattern was measured only for the antenna element 13 that is extended from the upper end of the upstanding section 3*a* into the right direction shown in FIG. 5, is bent in the middle in the downward direction shown in FIG. 5, and is further bent in the left direction shown in FIG. 5. In other words, the antenna element 13 does not have the routed portion A of the tuning section 3*b* of the first embodiment, and the overall structure thereof is not spirally turned. As a result of measurement in the comparative example (1) as shown in FIG. 6, the directivity pattern is significantly depressed both in the vertical polarization and the horizontal polarization.

Figure 7:
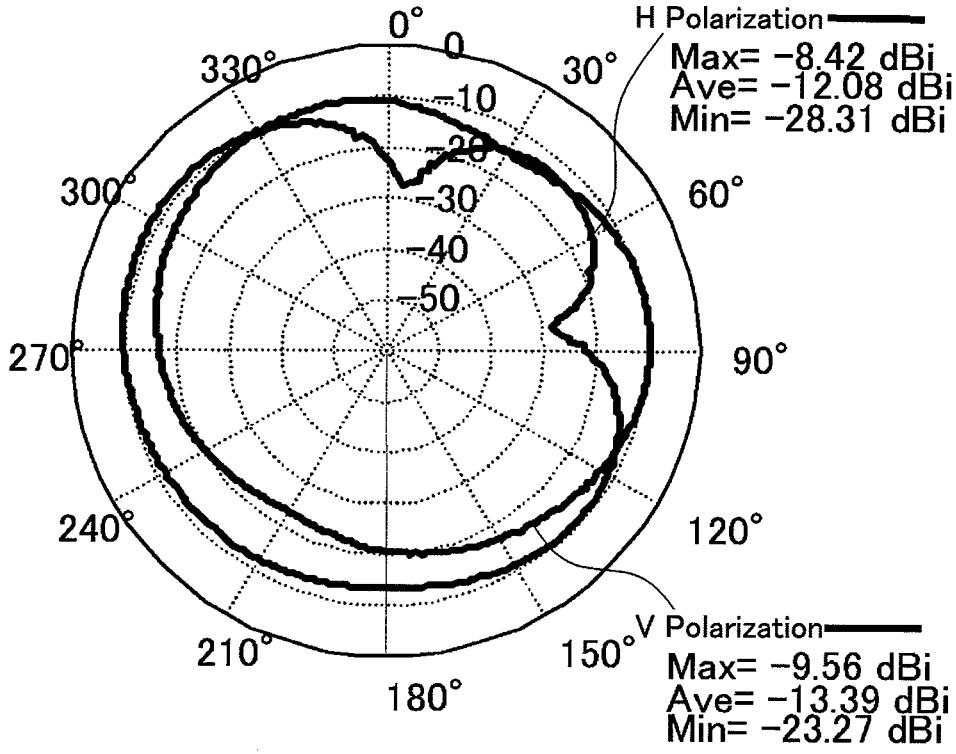
FIG. 7 is a graph showing the directional pattern in the parallel plane of the antenna device according to the first embodiment.
Figure 8:
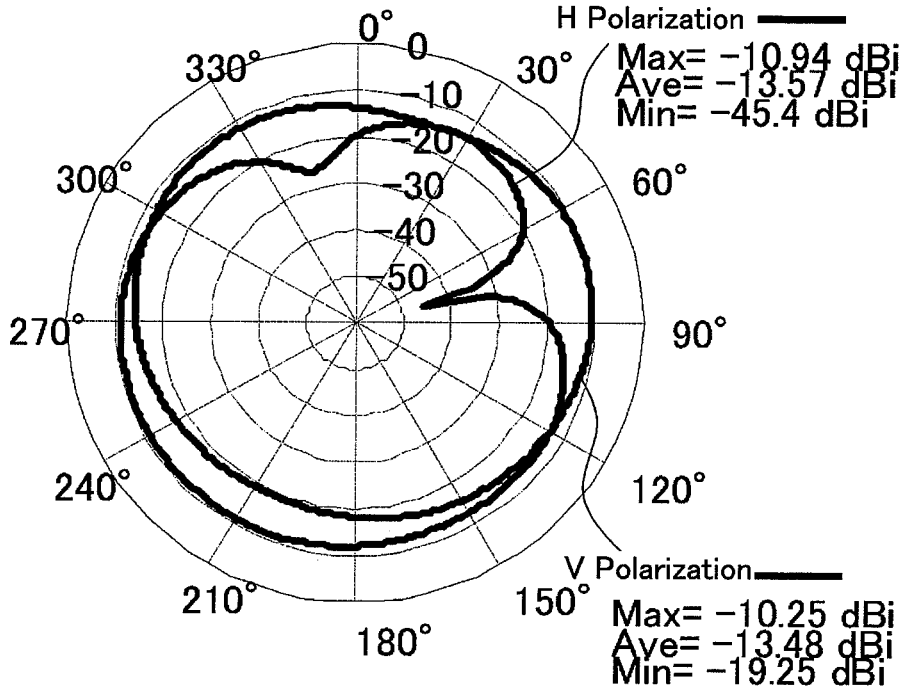
FIG. 8 is a graph showing the directional pattern in the parallel plane of the antenna device according to the variant example (1) of the first embodiment.

In contrast, in the antenna device of the first embodiment as shown in FIG. 7, a circular directional pattern with no depression is obtained in the vertical polarization, and a slightly-depressed directional pattern is obtained in the horizontal polarization, resulting in favorable characteristics as a whole. Also, as a variant example (1) of the first embodiment, the directional pattern was measured for the antenna element 13 in which the height of the upstanding section 3*a* of the first embodiment was reduced by half in the same manner as that of the first embodiment. Consequently, as shown in FIG. 8, although the horizontal polarization is partially depressed, the overall shape is close to that of the first embodiment, resulting in slightly-depressed directional pattern. This is because degradation of the characteristics and directivity is reduced by the provision of the matching circuit section 4.

Figure 9:
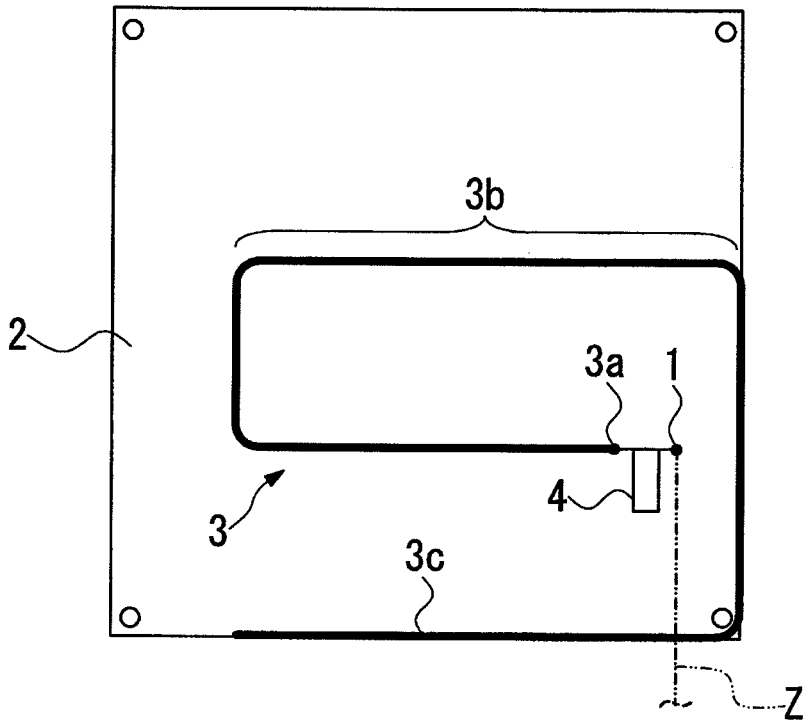
FIG. 9 is a simplified plan view showing the antenna device according to the variant example (2) of the first embodiment.
Figure 10:
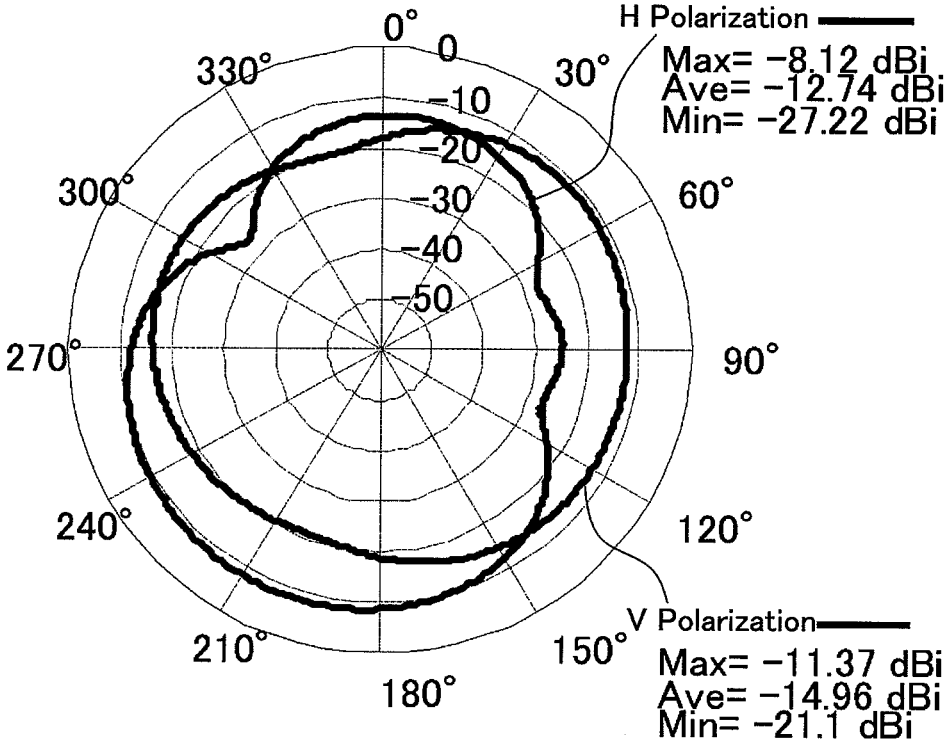
FIG. 10 is a graph showing the directional pattern in the parallel plane of the antenna device according to the variant example (2) of the first embodiment.

Furthermore, as a variant example (2) of the first embodiment as shown in FIG. 9, the directional pattern was measured for the antenna element 3 in which the way of the rotation of the antenna element 3 is changed with a different shape of the tuning section 3*b* in the same manner as that of the first embodiment. In other words, the tuning section 3*b* is extended from the upstanding section 3*a* in the left direction shown in FIG. 9, is bent in the middle in the upward direction shown in FIG. 9, and is further bent in the right direction shown in FIG. 9, and the open element section 3*c* is extended from the front end of the tuning section 3*b* in the downward direction shown in FIG. 9, is extended across the power feed point 1, and is bent in the middle in the left direction shown in FIG. 9. As a result of measurement in the variant example (2) as shown in FIG. 10, although the position of the depression in the vertical polarization is slightly changed, a slightly-depressed directional pattern is obtained both in the vertical polarization and the horizontal polarization.

In the first embodiment as described above, the matching circuit section 4, which matches the reactance of the antenna element 3 and that of the power feed line Z with each other, is provided on the base member 2, whereby the need for providing a matching stub is eliminated unlike the conventional inverse F-type antenna, and the occupation area for the stub-matching portion can be reduced. Also, in the antenna device, the antenna element 3 includes the tuning section 3*b* that is extended from the upper end of the upstanding section 3*a* into one direction in a parallel plane parallel to the base member 2, bent or curved in the middle, and then extended in the direction opposite the one direction, whereby the antenna element 3 can provide tuning to the desired polarization and directivity by setting the length and shape of the tuning section 3*b*. In particular, the overall external shape combined of the tuning section 3*b* and the open element section 3*c* is of substantially square shape, whereby the directivity is less-polarized, resulting in more omnidirectionally-uniform directivity.

Furthermore, since the antenna device includes the open element section 3*c* that is extended from the front end of the tuning section 3*b* in the direction in which the open element section 3*c* spirally turns in the parallel plane about the upstanding section 3*a*, favorable antenna radiation can be obtained from the open element section 3*c*. In addition, the open element section 3*c* is bent or curved in the middle, and the front end thereof is extended along the one direction, whereby the overall configuration is formed into a spiral shape, resulting in the reduction in size of the antenna device. Since omnidirectional directivity can be obtained and further miniaturization and thinning can be achieved, the antenna device of the present disclosure is thereby suitable for any one of a receiving antenna device, a transmitting antenna device, and a transmitting-receiving antenna device that are used for vehicle-mounted wireless communication system, in particular, keyless operation system.

The present disclosure is not limited to the first embodiment and various modifications may be made without departing the spirit of the present disclosure. For example, although the antenna element 3 is formed into a rectangular spiral shape constituted by a plurality of linear portions and bent portions in the first embodiment, the antenna element 3 may be formed into a circular spiral shape constituted by a continuous curved line as a whole. In addition, although the antenna element 3 is formed of a conductive wire such as a copper wire, the antenna element 3 may be formed of other conductive material. For example, the antenna element may be constituted as a strip shape (rectangular cross section) that is stamped out of a sheet metal.

Hereinafter, the antenna device according to the second embodiment of the present disclosure will be described with reference to FIGS. 11 to 23.

Figure 11:
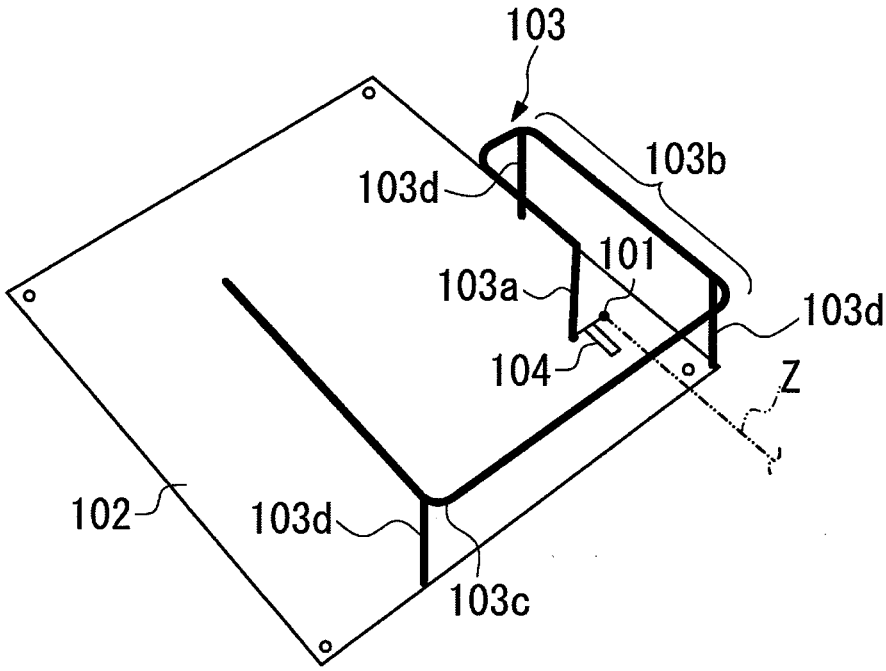
FIG. 11 is a simplified perspective view showing the antenna device according to a second embodiment of the present disclosure.
Figure 12:
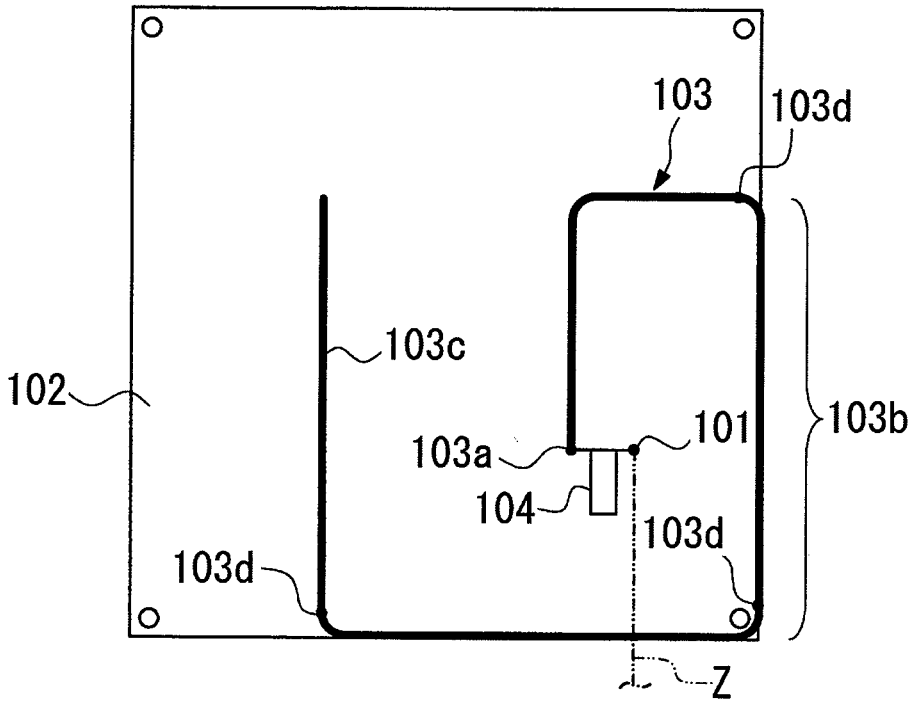
FIG. 12 is a simplified plan view showing the antenna device according to the second embodiment of the present disclosure.

The antenna device according to the second embodiment is, for example, a receiving antenna device, a transmitting antenna device, and a transmitting-receiving antenna device that are used for vehicle-mounted wireless communication system, in particular, keyless operation system. As shown in FIGS. 11 and 12, the antenna device includes a base member 102 having a power feed point 101 to which a 5051 power feed line Z is connected; an antenna element 103 connected to the power feed point 101 and erected on a base member 102; and a matching circuit section 104, which is connected to the power feed point 101 and the antenna element 103, provided on the base member 102, and matches the reactance of the antenna element 103 and that of the power feed line Z with each other.

It should be noted that the keyless operation system is a system that can perform a lock/unlock operation (so-called "keyless entry system") of a door and tailgate of a vehicle, an engine start-up operation, and the like by performing ID code verification through wireless communication between a key and a receiving antenna device provided on the vehicle body side when the driver or the like who carries a key referred to as "keyless operation key" having a wireless communication function approaches the vehicle within the wireless operation range.

The base member 102 is, for example, a wiring substrate or a circuit board. A wireless communication circuit and an electronic control unit (ECU), which are not shown, are formed on the upper surface and the lower surface of the base member 102, respectively. It should be noted that the antenna element 103 may be attached on the opposite side of the surface onto which the electronic control unit of the base member 102 is mounted. The antenna element 103 is formed of a conductive material such as a copper wire, a coated copper wire, a copper alloy wire (e.g., brass), an aluminum wire, a coated aluminum wire, an aluminum alloy wire, or the like with a ¼ length of the antenna operation wavelength or an integral fraction of its length, and the thickness of the wire may be set depending on desired characteristics. In addition, examples of the shape of such wire material includes a circular cross section, a rectangular cross section, a polygon cross section, and the like. The circular cross section is preferred in consideration of the wire to be bent. In addition, the antenna element may be configured such that an insulating layer is coated on the outer periphery of the above-described conductive material (wire material).

The antenna element 103 has the upstanding section 103*a* erected from the base member 102; the tuning section 103*b*, which corrects directivity or polarization, extended from the upper end of the upstanding section 103*a* into one direction in a parallel plane parallel to the base member 102, bent or curved in the middle, and then extended in the direction opposite the one direction; the open element section 103*c* extended from the front end of the tuning section 103*b* in the direction in which the open element section 103*c* spirally turns in the parallel plane about the upstanding section 103*a;* and at least one projecting element section 103*d*, which corrects directivity or polarization, projects from at least one of the tuning section 103*b* and the open element section 103*c*.

In other words, the tuning section 103*b* is arranged to be extended from the upper end of the upstanding section 103*a* into the upward direction shown in FIG. 12, is bent in the middle at 90° in the right direction shown in FIG. 12, and is further bent at 90° in the downward direction shown in FIG. 12. Thus, the tuning section 103*b* is a portion that is bent into the C-shaped configuration with a constant width in the parallel plane. The width, length, or the like of the portion is set depending on the desired polarization and directivity. It should be noted that the shape of the bent corner edges may be chamfered to some degree in a circular-arc shape as shown in FIG. 12 or may be bent perpendicularly.

In addition, the open element section 103*c* is bent at 90° from the front end of the tuning section 103*b* in the left direction shown in FIG. 12, is extended across the power feed point 101, and is bent in the middle at 90° in the upward direction shown in FIG. 12. Thus, the open element section 103*c* is a portion that is bent into the L-shaped configuration in the parallel plane.

In addition, the open element section 103*c* is bent or curved in the middle, and the front end thereof is extended along the one direction. Furthermore, the overall external shape combined of the tuning section 103*b* and the open element section 103*c* is of substantially square shape. In this way, the tuning section 103*b* and the open element section 103*c* are formed in a rectangular spiral shape about the power feed point 101.

Three projecting element sections 103*d* are provided so as to project toward the base member 102. Specifically, in the second embodiment, the projecting element sections 103*d* are provided at three positions corresponding to the corner portion of the tuning section 103*b*, the connecting portion which is the front end of the tuning section 103*b* and is for the connection with the open element section 103*c*, and the corner portion of the open element section 103*c*. Each of the front ends of these projecting element sections 103*d* is brought into abutment against the base member 102, but is not in connection or contact with the wiring lines on the base member 102 and is placed in an electrically floating state.

Figure 13:
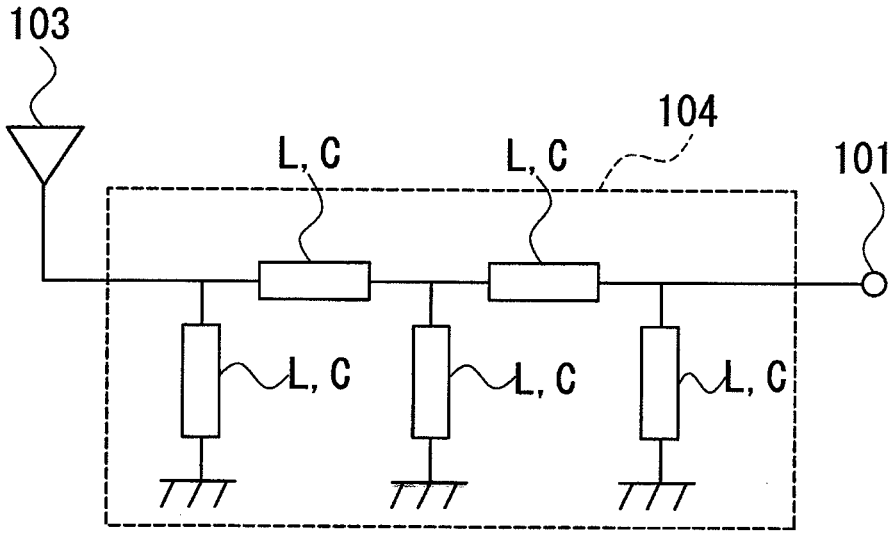
FIG. 13 is an equivalent circuit view showing a matching circuit section having a plurality of π-type LC circuits according to the second embodiment.
Figure 14:
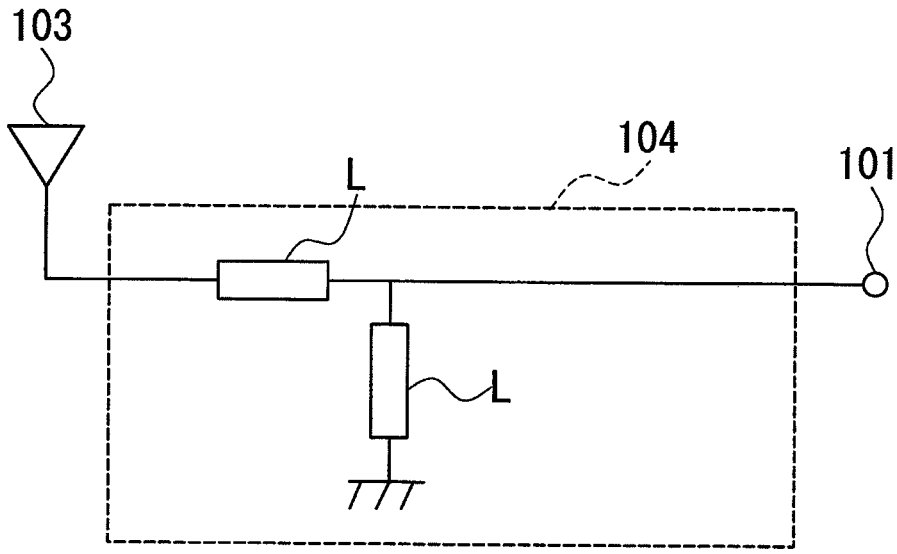
FIG. 14 is an equivalent circuit view showing the matching circuit section used in measuring the directional pattern according to the second embodiment.

As shown in FIGS. 13 and 14, the matching circuit section 104 is a circuit configuration in which a π-type LC circuit including a plurality of inductances L or capacitors C is provided in a single-stage or multiple-stages between the power feed point 101 and the antenna element 103. The matching circuit section 104 has a function corresponding to a portion that effects the matching from the power feed point to the stub in the conventional inverse F-type antenna.

Next, with respect to the antenna device of the second embodiment, a description will be given on the results obtained from the measurement of the directional pattern in the parallel plane for the actual polarization and directivity. It should be noted that in this measurement, a copper wire was used as the antenna element 103, and a circuit in which two inductances L are connected as shown in FIG. 14 was used as the matching circuit section 104.

Figure 15:
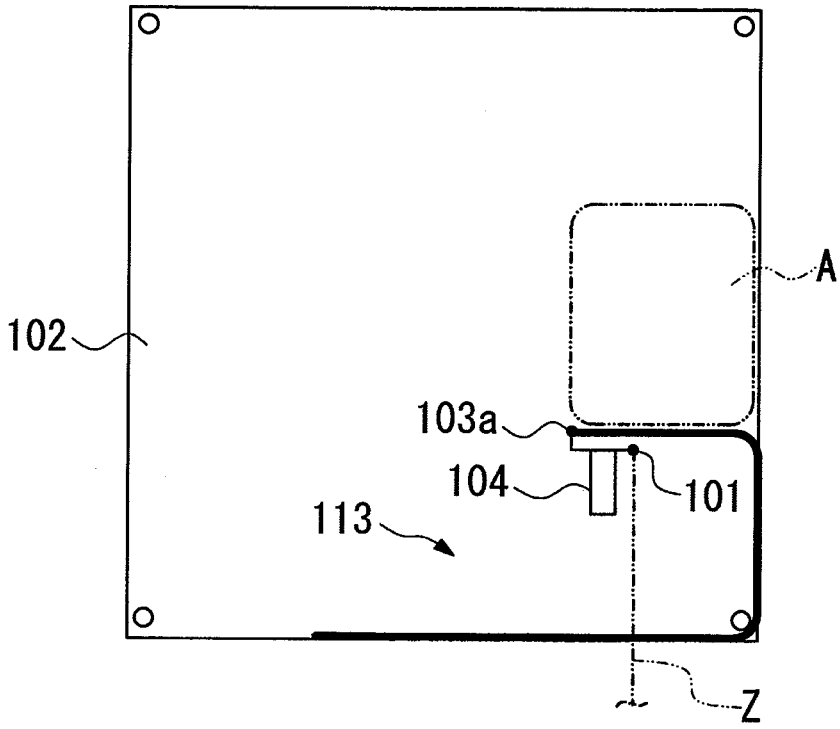
FIG. 15 is a simplified plan view showing the antenna device according to the comparative example (2) of the second embodiment.
Figure 16:
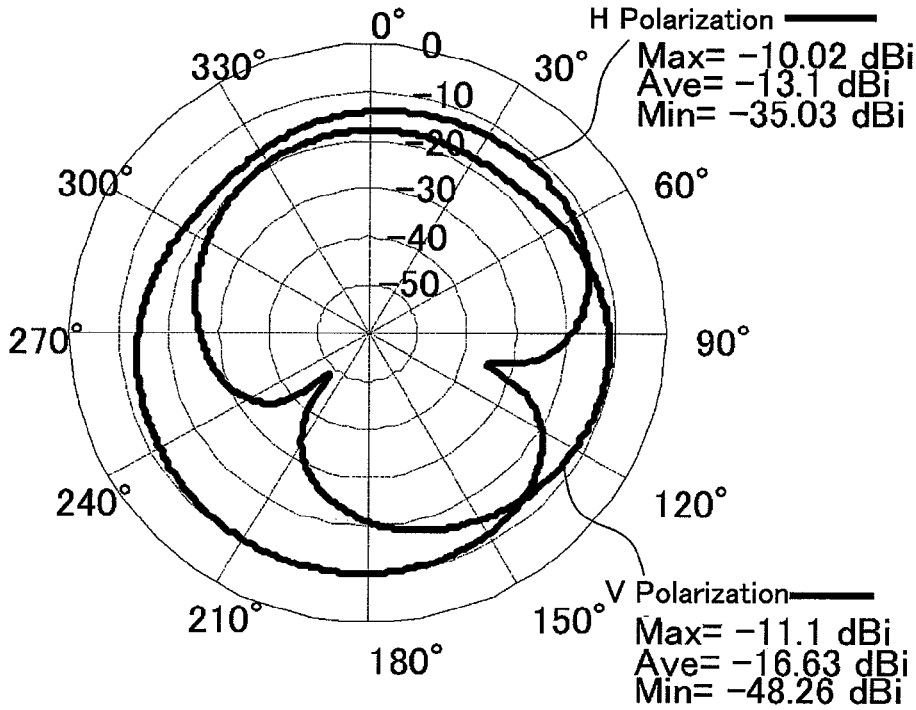
FIG. 16 is a graph showing the directional pattern in the parallel plane of the antenna device according to the comparative example (2) of the second embodiment.

First, as a comparative example (2), the directional pattern was measured for the antenna element 113 that is extended from the upper end of the upstanding section 103*a* into the right direction shown in FIG. 15, is bent in the middle in the downward direction shown in FIG. 15, and is further bent in the left direction shown in FIG. 15. In other words, the antenna element 113 does not have the routed portion A of the tuning section 103*b* of the second embodiment, and the overall structure thereof is not spirally turned. As a result of measurement in the comparative example (2) as shown in FIG. 16, the directivity is significantly-depressed both in vertical polarization and horizontal polarization.

Figure 17:
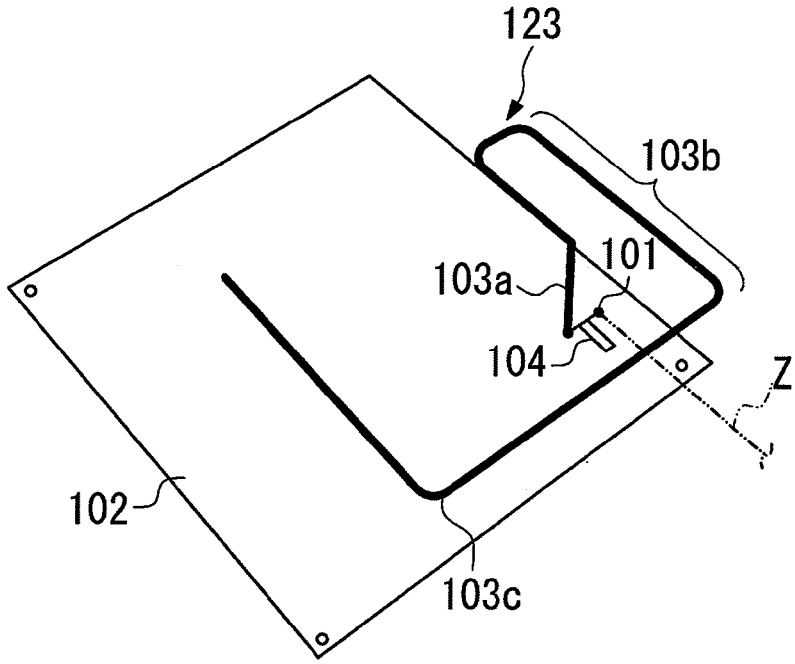
FIG. 17 is a simplified perspective view showing the antenna device according to the comparative example (3) of the second embodiment.
Figure 18:
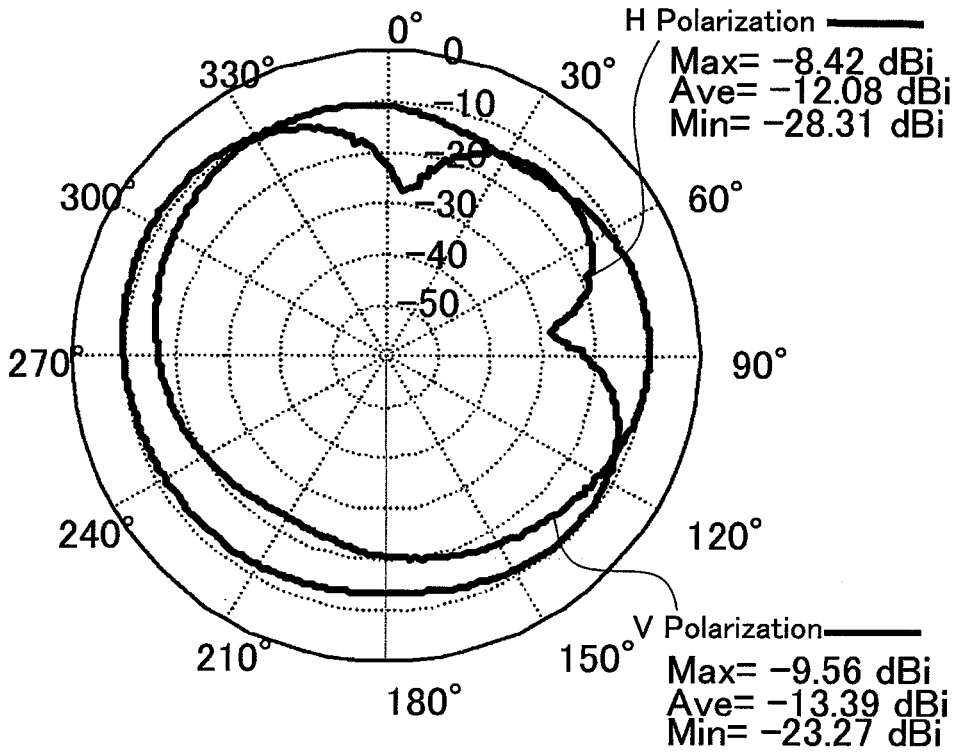
FIG. 18 is a graph showing the directional pattern in the parallel plane of the antenna device according to the comparative example (3) of the second embodiment.

As a comparative example (3), the directional pattern was measured for the same antenna device having an antenna element 123 as the antenna element 103 of the second embodiment except that three projecting element sections 103*d* have been removed therefrom, as shown in FIG. 17. Consequently, as shown in FIG. 18, a circular directional pattern with no depression is obtained in the vertical polarization, and a slightly-depressed directional pattern is obtained in the horizontal polarization, resulting in relatively favorable characteristics as a whole. However, the directional pattern of vertical polarization has no dent, but the characteristics thereof are lowered. In particular, the characteristics near about 210° indicate a low value of about −22 dBi.

Figure 19:
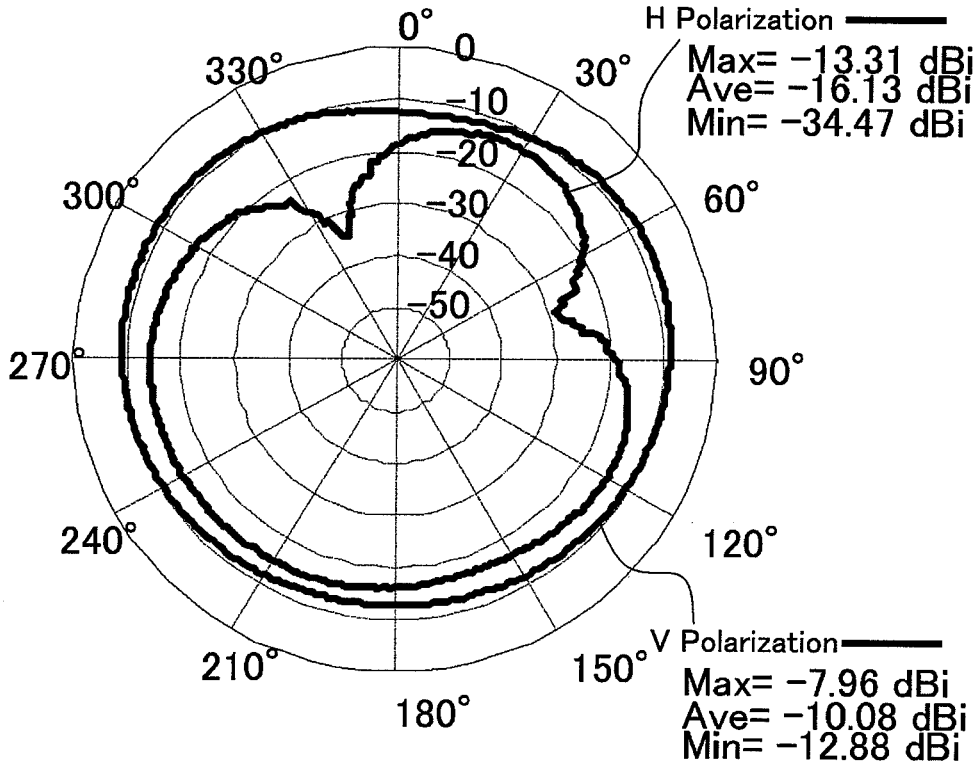
FIG. 19 is a graph showing the directional pattern in the parallel plane of the antenna device according to the second embodiment.

In contrast, as shown in FIG. 19, the antenna device of the second embodiment improves the directivity of vertical polarization. In particular, the characteristics near about 210° indicate about −11 dBi which is improved by about 10 dB.

Figure 20:
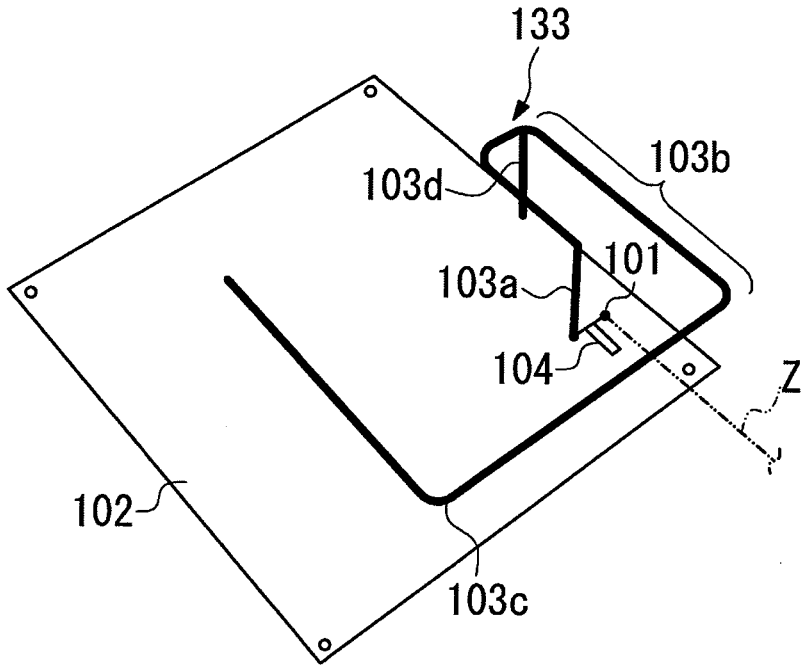
FIG. 20 is a simplified perspective view showing the antenna device according to the variant example (3) of the second embodiment.
Figure 21:
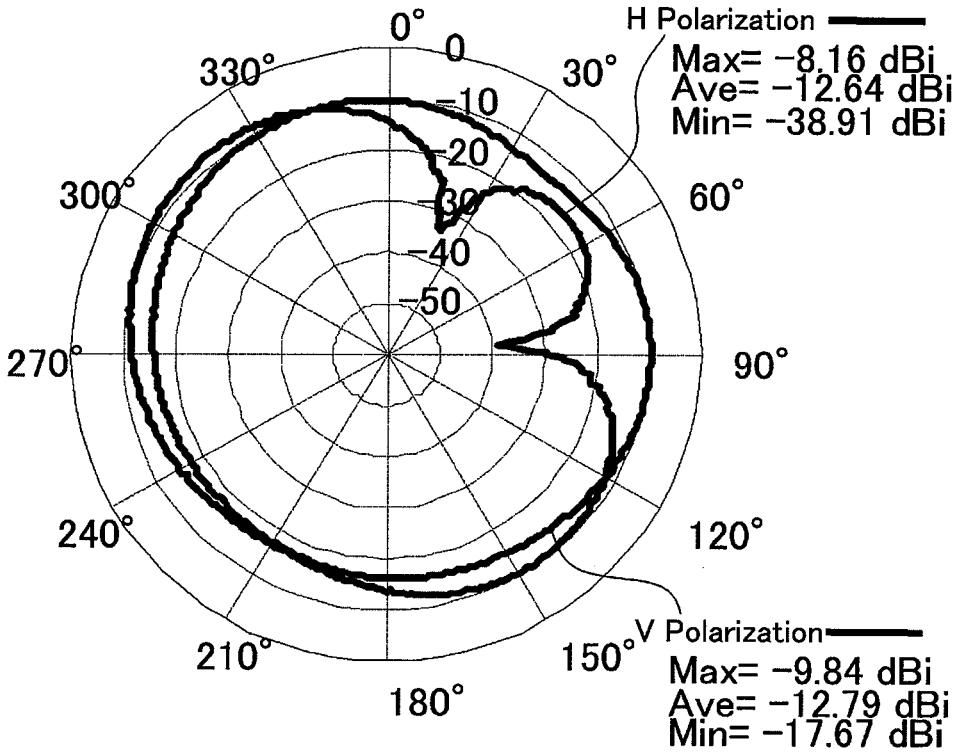
FIG. 21 is a graph showing the directional pattern in the parallel plane of the antenna device according to the variant example (3) of the second embodiment.

As a variant example (3) of the second embodiment as shown in FIG. 20, the directional pattern was measured for the antenna element 133 in which only one of three projecting element sections 103*d* of the second embodiment was left at the corner portion of the tuning section 103*b* in the same manner as that of the first embodiment. Consequently, as shown in FIG. 21, it will be seen that the characteristics are improved by 5 dB compared to that of the antenna element in which no projecting element sections 103*d* is provided (comparative example (3) in FIG. 17). In comparison with the antenna element of the second embodiment provided with three projecting element sections 103*d*, the improved numerical value and orientation become small because the number of the projecting element sections 103*d* is reduced from three to one. However, an improving effect is clearly observed. In this way, it will be understood that the orientation and characteristics of directivity to be improved are enhanced depending on the number and position of the projecting element sections 103*d*.

Figure 22:
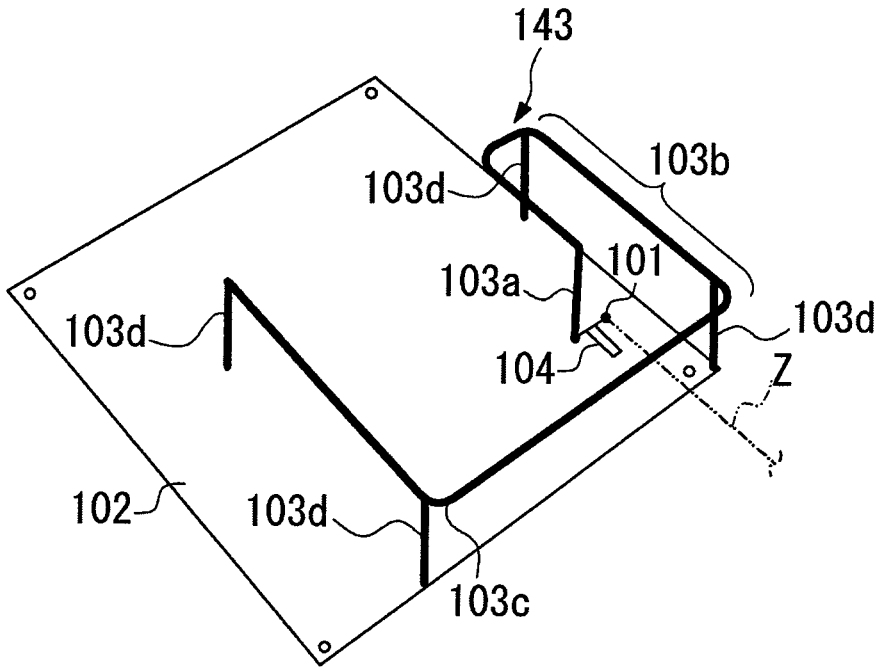
FIG. 22 is a simplified perspective view showing the antenna device according to the variant example (4) of the second embodiment.
Figure 23:
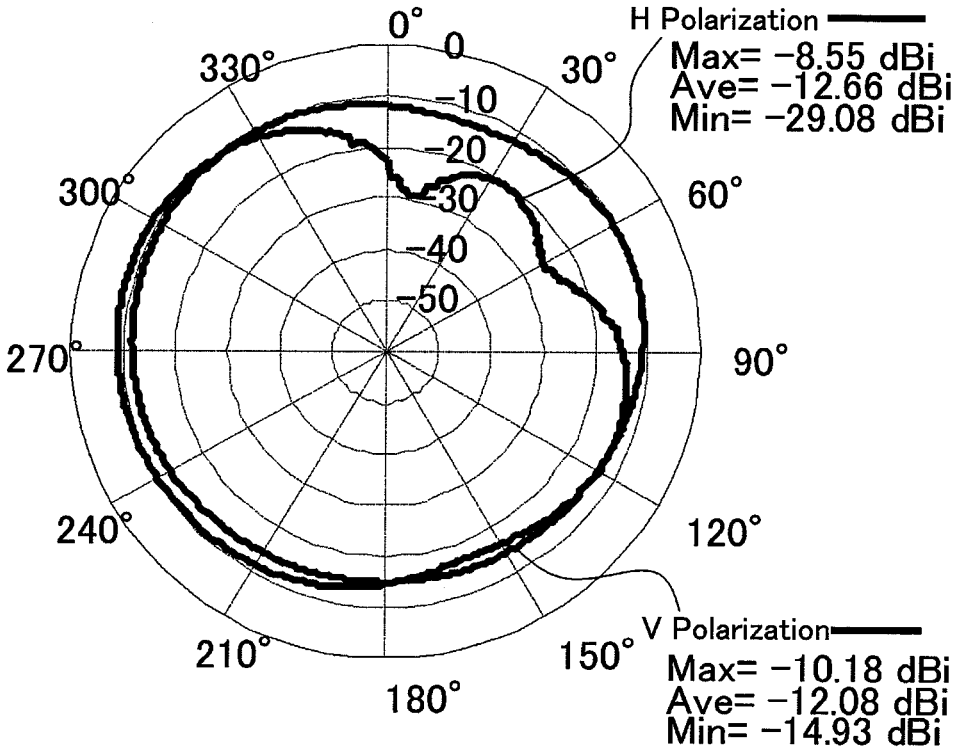
FIG. 23 is a graph showing the directional pattern in the parallel plane of the antenna device according to the variant example (4) of the second embodiment.

As a variant example (4) of the second embodiment as shown in FIG. 22, the directional pattern was measured for an antenna element 143 in which one additional projecting element section 103*d* was provided at the front end of the open element section 103*c* in addition to three projecting element sections 103*d* of the antenna element 103 of the second embodiment in the same manner as that of the first embodiment. Consequently, as shown in FIG. 23, it will be seen that the directivity of horizontal polarization is also improved. In the variant example (4), this seems to be caused by the extension of an effective length of the antenna element 143 by the addition of the projecting element section 103*d* at the front end of the open element section 103*c*.

In the second embodiment as described above, the matching circuit section 104, which matches the reactance of the antenna elements 103, 133, and 143 and that of the power feed line Z with each other, is provided on the base member 102, whereby the need for providing a matching stub is eliminated unlike the conventional inverse F-type antenna, and the occupation area for the stub-matching portion can be reduced. Also, in the antenna device, each of the antenna elements 103, 133, and 143 includes the tuning section 103*b* that is extended from the upper end of the upstanding section 103*a* into one direction in a parallel plane parallel to the base member 102, bent or curved in the middle, and then extended in the direction opposite the one direction, whereby the antenna element can provide tuning to the desired polarization and directivity by setting the length and shape of the tuning section 103*b*. In particular, the overall external shape combined of the tuning section 103*b* and the open element section 103*c* is of substantially square shape, whereby the directivity is less-polarized, resulting in more omnidirectionally-uniform directivity.

Each of the antenna elements 103, 133, and 143 include at least one projecting element section 103*d* that projects from at least one of the tuning section 103*b* and the open element section 103*c*, whereby the antenna element permits more tuning of the tuning section 103*b* to the desired polarization and directivity by setting the position, number, length, and orientation of the projecting element section 103*d*. In addition, the open end is increased by the projecting element section 103*d*, resulting in an increase in radiation intensity. In particular, the projecting element section 103*d* is provided at the front end of the open element section 103*c*, whereby an effective length of the overall antenna element is extended, resulting in more improvement in the directivity of horizontal polarization.

Furthermore, the projecting element section 103*d* projects toward the base member 102, whereby the projecting element sections 103*d* are disposed between the tuning section 103*b* and the base member 102 and between the open element section 103*c* and the base member 102, and the reduction in size of the overall device is not precluded. In particular, the front end of the projecting element section 103*d* is brought into abutment against the base member 102, whereby the projecting element section 103*d* functions as a support that supports the antenna elements 103, 133, and 143.

Furthermore, since the antenna device includes the open element section 103*c* that is extended from the front end of the tuning section 103*b* in the direction in which the open element section 103*c* spirally turns in the parallel plane about the upstanding section 103*a*, favorable antenna radiation can be obtained from the open element section 103*c*. In addition, the open element section 103*c* is bent or curved in the middle, and the front end thereof is extended along the one direction, whereby the overall configuration is formed into a spiral shape, resulting in the reduction in size of the antenna device. Since omnidirectional directivity can be obtained and further miniaturization and thinning can be achieved, the antenna device of the present disclosure is thereby suitable for any one of a receiving antenna device, a transmitting antenna device, and a transmitting-receiving antenna device that are used for vehicle-mounted wireless communication system, in particular, keyless operation system.

The present disclosure is not limited to the second embodiment and various modifications may be made without departing the spirit of the present disclosure. For example, although the antenna element 103 is formed into a rectangular spiral shape constituted by a plurality of linear portions and bent portions in the second embodiment, the antenna element 103 may be formed into a circular spiral shape constituted by a continuous curved line as a whole.

In addition, although the antenna element 103 is formed of a conductive wire such as a copper wire, the antenna element 103 may be formed of other conductive material. For example, the antenna element may be constituted as a strip shape (rectangular cross section) that is stamped out of a sheet metal. Furthermore, as described above, it is preferred that the projecting element section 103*d* be projected toward the base member 102 in view of device miniaturization, the projecting element section 103*d* may be provided in a projecting manner in other direction that is the opposite direction of the base member 102.

What is claimed is:

1. An antenna device comprising:

a base member, which is a wiring substrate, having a power feed point to which a power feed line is connected;

an antenna element connected to the power feed point and erected on the base member; and a matching circuit section, which is connected to the power feed point and the antenna element, provided on the base member, and matches the reactance of the antenna element and that of the power feed line with each other, wherein the antenna element includes:

an upstanding section extending from the base member in a direction perpendicular to the base member;

a tuning section, which corrects directivity or polarization of a radiation signal, extending from the upper end of the upstanding section in a first direction in a plane parallel to the base member, bent or curved in the middle, and then extending in a second direction opposite the first direction; and an open element section extending from the front end of the tuning section in a direction in which the open element section spirally turns about the upstanding section in the plane parallel to the base member.

2. The antenna device according to claim 1, wherein the open element section is bent or curved in the middle and the front end thereof extends along the first direction.

3. The antenna device according to claim 2, wherein the overall external shape of the combination of the tuning section and the open element section is a substantially square shape.

4. The antenna device according to claim 1, further comprising:

at least one projecting element section, which corrects directivity or polarization of the radiation signal, projecting from at least one of the tuning section and the open element section.

5. The antenna device according to claim 4, wherein the at least one projecting element section projects toward the base member.

6. The antenna device according to claim 5, wherein the front end of the at least one projecting element section is brought into abutment against the base member.

7. The antenna device according to claim 4, wherein the at least one projecting element section is provided at the front end of the open element section.

8. The antenna device according to claim 5, wherein the at least one projecting element section is provided at the front end of the open element section.

9. The antenna device according to claim 6, wherein the at least one projecting element section is provided at the front end of the open element section.

10. The antenna device according to claim 5, wherein the at least one projecting element section is placed in an electrically floating state.

* * * * *